United States Patent [19]

Lomas, III et al.

[11] 4,046,091

[45] Sept. 6, 1977

[54] METHOD AND APPARATUS FOR SECURING PYLON AND DECK TO THE HULL OF A SAILING VESSEL

[75] Inventors: James Arthur Lomas, III, Dana Point; Ronald La Verne Lee, Anaheim; Andrew Macdonald Holland, Capistrano, all of Calif.

[73] Assignee: Coast Catamaran Corporation, Irvine, Calif.

[21] Appl. No.: 731,661

[22] Filed: Oct. 12, 1976

[51] Int. Cl.[2] ..... B63H 9/06

[52] U.S. Cl. ..... 114/39; 9/6 P; 114/61; 114/65 R; 156/293; 156/305

[58] Field of Search ..... 114/39, 93, 61, 65 R, 114/90, 292; 9/6 P; 156/293, 305

[56] References Cited

U.S. PATENT DOCUMENTS

| | | | |
|---|---|---|---|
| 80,884 | 8/1868 | Stevens et al. | 114/93 |
| 3,454,440 | 7/1969 | Vezirakis | 156/293 X |
| 3,467,345 | 9/1969 | Windecker | 9/6 P |
| 3,507,240 | 4/1970 | Butler | 114/39 |
| 3,616,772 | 11/1971 | Popkin | 114/39 |
| 3,760,439 | 9/1973 | Swenson, Sr. | 9/6 P |
| 3,796,175 | 3/1974 | Ford, Jr. | 9/6 P X |
| 3,802,366 | 4/1974 | Mankawich | 114/39 |

*Primary Examiner*—Trygve M. Blix
*Assistant Examiner*—Sherman D. Basinger
*Attorney, Agent, or Firm*—Tilton, Fallon, Lungmus, Chestnut & Hill

[57] ABSTRACT

A tubular pylon secured to a deck is provided with a core telescopically and slidably received in its distal end. In securing the deck to the hull, a well is provided in a shoe to be received in and secured to the hull. Glue is inserted in the well and applied along the intended glue seam between the deck and hull. The deck/pylon assembly and hull are then assembled to be clamped in a jig. During assembly, the core acts as a plunger to force glue in the well of the shoe upwardly about the outer surface of the pylon to secure the pylon to the shoe. The core is frictionally held by the pylon to exert a desired force in holding the shoe against the inside of the hull while the adhesive sets to secure the shoe to the hull and the deck to the hull.

5 Claims, 3 Drawing Figures

METHOD AND APPARATUS FOR SECURING PYLON AND DECK TO THE HULL OF A SAILING VESSEL

BACKGROUND AND SUMMARY

The present invention relates to sailing vessels; and more particularly it relates to sailing vessels of the catamaran type, which are characterized as having two laterally spaced hulls. In a catamaran, the hulls may be spaced apart by a rigid framework which also supports a trampoline on which the occupants sit or lie. This framework also supports the mast and boom. The framework is conventionally made of hollow aluminum tubes, and it is secured at each side to the associated hull at forward and rear locations by means of upright tubular members, called "pylons" which are embedded in the hull. These pylons are substantially cylindrical, although they actually have a greater fore-to-aft dimension in cross section, thereby providing a teardrop shape.

Each of the hulls is provided with a deck for covering the same, and each hull is secured to its associated deck by means of an upper glue seam extending throughout conforming portions on the periphery of the deck. Not only is a pylon secured to a hull, but it is also rigidly secured to the deck through which it passes.

In the past, pylons have been cut to length and first rigidly secured to a deck. A "shoe" is inserted in the hull for each pylon, and the deck/pylon sub-assembly is then assembled to a hull by inserting the pylons in their respective shoes and clamping the hull to the pylon along the glue seam.

A problem has arisen in this method of construction, and it concerns the tolerances in the length of the pylon, together with the particular deck/hull fit. It the pylon is too long, when the deck is clamped to the hull, the pylon will bear on the shoe and cause it to deform or form a "print" on the hull. It will also exert a force tending to part the deck and hull along the glue seam after the hull is removed from the glue jig. Further, because the pylon is a hollow tube, much of the glue originally in the well simply fills the cavity in the pylon so as to not perform its function of securing the outer surface of the pylon to the well of the shoe. If, on the other hand the pylon is too short for a particular deck-/hull combination, then it will not exert sufficient force on the shoe to insure rigid attachment of the shoe to the hull, such force being necessary during the setting or drying of the glue.

According to the present invention, a cylindrical core or plug of semi-rigid plastic foam is placed telescopically into the distal end of the pylon, where it is held by friction enhanced and by means of internally projecting rivets securing a pylon strap to the pylon for additional holding power. The foam core extends partially out from the distal end of the pylon prior to assembly with the shoe.

After glue is placed in the well of the shoe, the deck and pylon are assembled to the hull. When the deck is clamped to the hull, the foam core is urged upwardly into the hollow pylon to the extent necessary to exactly compensate for the proper glue seam between deck and hull. The internal projection of the rivets offer proper resistance to insertion of the foam core so that the glue in the well is displaced upwardly about the outer surface of the pylon as it is inserted, thereby insuring a strong bond between pylon and shoe. Further, because of the resistance to insertion of the foam core into the pylon during assembly, a force is applied to the shoe to urge it against the hull, but it is not an excessive force so that there is no bulge or printing on the exterior of the hull. Thus, the pylons can be cut somewhat shorter than heretofore, and the length of the pylon is not a critical element in pylon/shoe, shoe/hull or hull/deck bonding, as it had been in the past.

Other features and advantages of the present invention will be apparent to persons skilled in the art from the following detailed description of a preferred embodiment accompanied by the attached drawing wherein identical reference numerals will refer to like parts in the various views.

THE DRAWING

DETAILED DESCRIPTION

Figure 1:
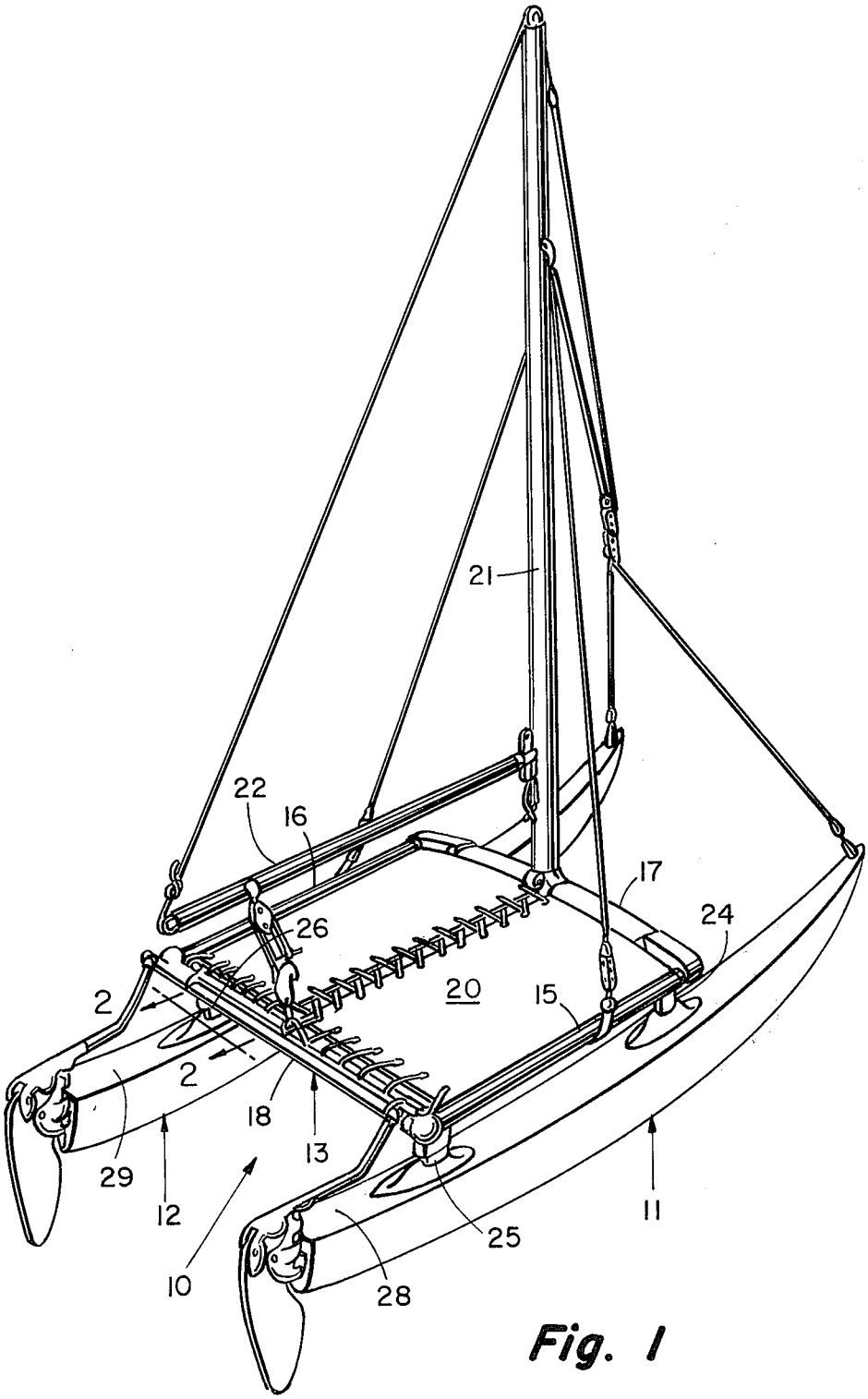
FIG. 1 is an upper perspective view, taken from the right rear side, of a catamaran sailboat constructed according to the present invention.

Referring first to FIG. 1, there is shown a catamaran sailboat, generally designated by reference numeral 10. Such a sailboat has two elongated hulls, generally designated respectively 11 and 12. The hulls 11, 12 are maintained in spaced relation by a rigid metal frame structure 13 which is preferably made of hollow aluminum tubes.

The frame 13 has two side frame members 15 and 16 which extend longitudinally of the hull 11, 12, respectively. The side frame members 15, 16 are joined together by forward and rear cross members 17, 18 which not only rigidly join the hulls together, but provide a framework for a flexible deck or trampoline, generally designated 20. The frame 13 also provides a base for mounting a conventional mast 21 to which a boom 22 is pivotally mounted, as is known.

The frame 13 is secured to the hull 11 by forward and rear pylons 24, 25; and it is similarly secured to the hull 12, only the rear pylon 26 being shown, however, for the left side.

Each of the hulls 11, 12 are similar in structure, although for the particular catamaran that is illustrated, these hulls are of the so-called asymmetrical type—that is, although the hulls are mirror images of each other, they do not possess individual symmetry about a longitudinal vertical plane. Each hull is covered with a deck, and these are designated respectively 28 and 29.

The pylons are secured not only to their associated hulls, but they are also secured to the decks for the hulls, and it is the method and apparatus for securing the pylons, hulls and decks together which provides the basis for the present invention. From an explanation of the attachment of the pylon to a hull, the attachment of all pylons to the hulls will be apparent.

Figure 2:
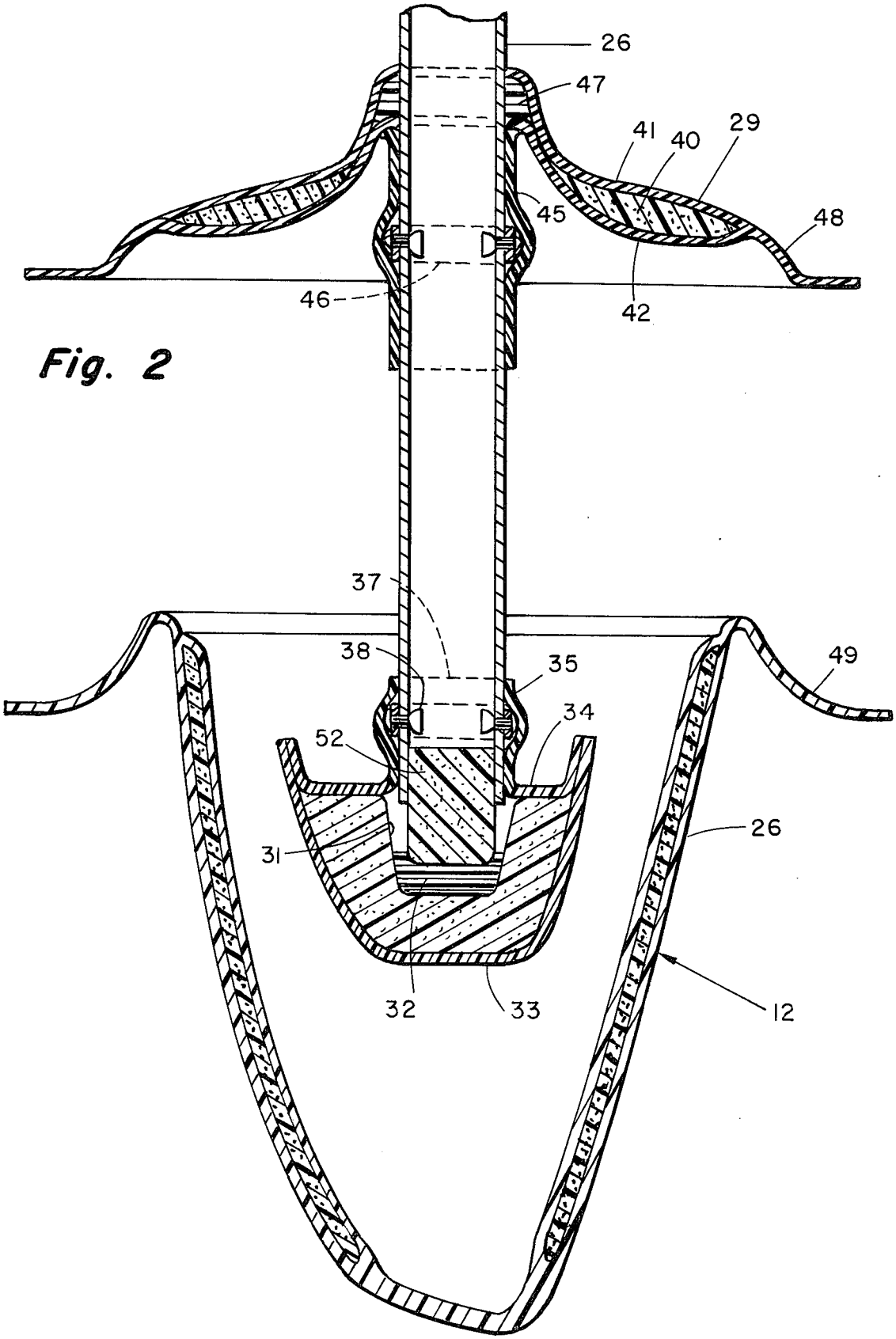
FIG. 2 is a vertical transverse cross sectional view taken through one of the hulls of the boat of FIG. 1, prior to assembly of a deck/plyon sub-assembly to the hull.

Turning then to FIG. 2, the pylon 26 is shown to be a substantially cylindrical hollow tubular element. A shoe for attaching the lower or distal end of the pylon 26 to the hull 12 is designated 30, and it includes a well 31 with a substantially cylindrical or slightly tapered sidewall conforming to the shape of the pylon. The lower end of the well is filled with glue, seen at 32. The shoe 30 may be formed of rigid plastic foam, and it includes an exterior cover of Fiberglas matt and cloth 33 for bonding to the interior of the hull 12. The shoe also includes an upper layer of Fiberglas matt and cloth 34 which extends upwardly about the distal end of the pylon 26, as at 35.

A strap or collar 37 is secured to the pylon 26 by means of rivets 38 at a location adjacent the distal end of the pylon. The strap 37 provides an enhanced mechanical coupling between the matt 35 and the body of the shoe 30.

The deck 29 is seen to be a conventional deck with an inner foam core 40 and upper and lower deck plates 41, 42. The deck 29 is secured to the pylon 26 by means of Fiberglas matt and cloth wrappings 45 which extend downwardly about the outer surface of the pylon and beneath the lower deck plate 42. An additional pylon strap 46 is provided to enhance the mechanical coupling between the wrappings 45 and deck 29; and an upper glue joint 47 is further provided to attach the pylon to the deck. As indicated above, the pylon is attached to the deck to form a deck/pylon sub-assembly; and this joint is cured prior to attaching the sub-assembly to the hull.

It will be observed from FIG. 2 that the deck 29 provides an outer peripheral flange 48 which conforms to a similarly shaped peripheral flange 49 on the hull 26. The deck flange 48 and hull flange 49 provide an area for a glue seam generally designated 50 in FIG. 3 which ultimately secures the deck to the hull, and extends completely around the interface between the two.

Returning to FIG. 2, a cylindrical core or plug 52 conforming to the inner diameter of the pylon 26 is inserted into the open distal end of the pylon, prior to assembly of the shoe 30. The core 52 may be formed of a semi-rigid plastic foam, such as polyurethane; and as illustrated, it may be inserted initially to a depth just prior to its contacting the inwardly projecting portions of rivets 38. The frictional engagement between the core and pylon, and the interference provided by the inwardly projecting portions of the rivets 38 form a restraining force inhibiting the total insertion of the foam core 52. Since the core 52 is of semi-rigid foam, it may be torn or broken away without excessive force, but the restraining force just described is sufficient to require an insertion force of approximately 15 pounds to fully insert the core 52 into the pylon. This is important because, as will be appreciated from a full understanding of the invention, it is this restraining force which ultimately urges the shoe 30 into contact with the interior of the hull 12 when the deck and hull are clamped together.

After the core 52 is inserted, the shoe 30 is assembled to the pylon, and the wrappings 35 formed about the outer surface of the pylon. Next, the rigidly secured deck/pylon sub-assembly, together with the loosely held shoe (both front and rear) is assembled to the hull. Typically, the relationship of the elements is as shown in FIG. 2, but they are inverted because the glue jig is designed to secure the hull and deck together in an inverted position.

Figure 3:
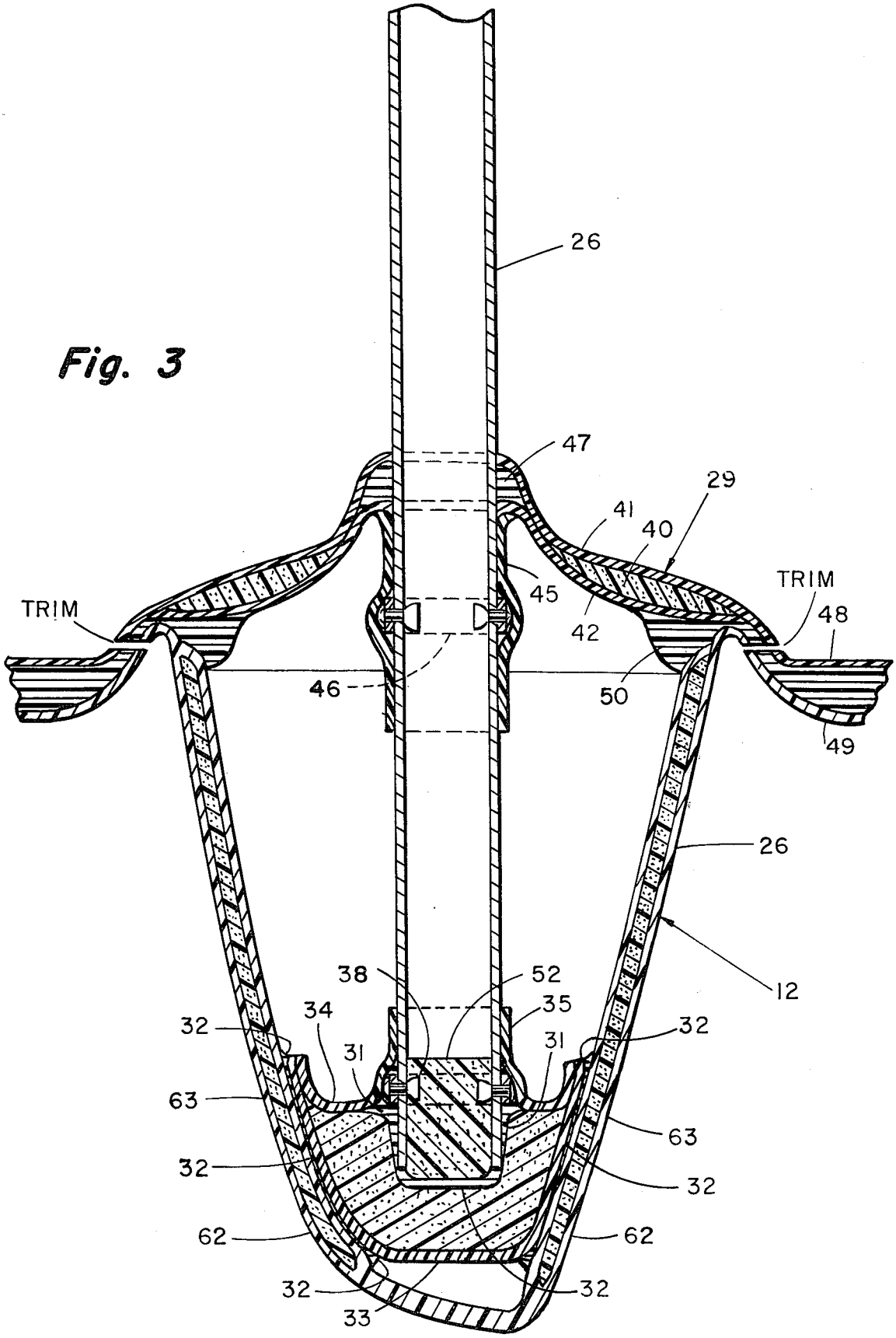
FIG. 3 is a view similar to FIG. 2, showing the deck, hull and pylon is assembled relation.

Turning now to FIG. 3, when the deck/pylon sub-assembly is assembled to the hull 26, the core 52 acts as a plunger to force the glue 32 from the bottom of the well 31 into the crevice between the side wall of the well and the outer surface of the pylon. Typically, a polyester glue is used not only to secure the pylon to the shoe, but to secure the shoe to the hull.

It will be observed that as the core 52 is urged from the position of FIG. 2 to that shown in FIG. 3, resistance is provided against the telescopic reception of the core by means of the inwardly projecting portions of the rivets 38; and this provides a uniform force urging the shoe into engagement with the hull until the glue sets. This urging force will be present even though the pylon may be cut shorter than is shown. Hence, the attachement can be made independent of the length of the pylon as long as the pylon does not exceed a predetermined overall length. It will also be observed that a more uniform glue seam 50 between the hull flange and deck flange may be obtained because the clamping pressure and distances will be uniform during glue set, and when the overall assembly is removed from the jig, there is no force tending to separate the deck from the hull. As indicated above, in the prior method, if the pylon were cut too long, it would exert too great a force on the shoe, and this would cause printing in the areas designated 62 and 63 on the outer surface of the hull, and it would also create a parting force tending to separate the glue seam 50. The extreme outer portions of the flanges 48, 49 are trimmed away after the assembly is removed from the jig, as shown in FIG. 3.

Having thus described in detail a preferred embodiment of the invention, persons skilled in the art will be able to modify certain of the steps which have been disclosed and to substitute equivalent structures or materials for those described while continuing to practice the principle of the invention; and it is, therefore, intended that all such modifications and substitutions be covered as they are embraced within the spirit and scope of the appended claims.

We claim:

1. In a method of securing a pylon and a deck to the hull of a sailboat, the pylon being a hollow tubular element, the steps comprising inserting a core into said pylon so that it extends at least partially outwardly from the distal end thereof; inserting glue into a well in a pylon shoe adapted to receive said pylon; and then assembling said pylon and deck and shoe to said hull so that the glue in said well is forced by said core into the space between the sidewall of said well and the outer surface of said pylon, and said core is displaced telescopically into said pylon to exert a constant, controlled force for urging said shoe into engagement with said hull.

2. The method of claim 1 wherein said core comprises a substantially cylindrical element of semi-rigid plastic foam sized to frictionally engage the inner wall of said pylon.

3. The method of claim 1 further comprising means extending inwardly of the inner wall of said pylon for engaging said core and at least partially obstructing the telescopic reception of said core in said pylon to control the application of force from said pylon through said core to urge said shoe into engagement with said hull.

4. The method of claim 1 wherein said pylon is first secured to said deck to form a deck/pylon sub-assembly prior to securing said deck to said hull.

5. Apparatus for securing a deck, a hull, and a pylon of a sailboat together comprising: means rigidly securing said deck to said pylon, said pylon extending through said deck and including a tubular member with an open distal end; a semi-rigid core telescopically received in the distal end of said pylon and at least partially extending outwardly therefrom; a shoe defining a well adapted to receive said pylon and core and secured to said hull; a body of liquid glue in said well; and means for controlling the insertion force of said core into said pylon, whereby when said pylon is inserted into said well, and said hull attached to said deck, said glue blows from between the bottom of said well and said core to the space between said pylon and the sidewall of said shoe, and said core will be displaced inwardly into said pylon to exert a controlled force to hold said shoe into engagement with said hull.

* * * * *

UNITED STATES PATENT AND TRADEMARK OFFICE

CERTIFICATE OF CORRECTION

PATENT NO. : 4,046,091

DATED : September 6, 1977

INVENTOR(S) : James Arthur Lomas, III et al

It is certified that error appears in the above-identified patent and that said Letters Patent are hereby corrected as shown below:

In column 5, line 4, "blows" should be --flows--.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*